US006291977B1

(12) United States Patent
Iliasevitch

(10) Patent No.: US 6,291,977 B1
(45) Date of Patent: Sep. 18, 2001

(54) DIFFERENTIAL CURRENT MIRROR WITH LOW OR ELIMINATED DIFFERENTIAL CURRENT OFFSET

(75) Inventor: Stepan Iliasevitch, Nepean (CA)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/537,662

(22) Filed: Mar. 29, 2000

(51) Int. Cl.[7] ..... G05F 3/16; G05F 3/20
(52) U.S. Cl. ..... 323/315; 323/312
(58) Field of Search ..... 323/312, 315; 330/288, 257

(56) References Cited

U.S. PATENT DOCUMENTS

| | | | | |
|---|---|---|---|---|
| 4,583,037 | * | 4/1986 | Sooch | 323/315 |
| 4,618,815 | * | 10/1986 | Swanson | 323/315 |
| 5,371,476 | * | 12/1994 | Nishioka | 330/255 |
| 5,436,594 | * | 7/1995 | Pace et al. | 330/258 |
| 5,517,143 | * | 5/1996 | Gross | 330/288 |
| 5,929,678 | * | 7/1999 | Kaserkovitz et al. | 327/157 |
| 5,966,050 | * | 10/1999 | Yoshino et al. | 330/255 |
| 5,977,760 | * | 11/1999 | Kimura | 323/316 |
| 6,060,956 | * | 5/2000 | Mole et al. | 331/117 R |
| 6,081,131 | * | 6/2000 | Ishii | 326/68 |
| 6,087,819 | * | 7/2000 | Kuroda | 323/315 |

OTHER PUBLICATIONS

Sedra, A.S., et al, "Microelectronic Circuits", 3rd Edition, Oxford University Press, 1991, pp. 428–435.

* cited by examiner

*Primary Examiner*—Peter S. Wong
*Assistant Examiner*—Bao Q. Vu
(74) *Attorney, Agent, or Firm*—Victoria Donnelly

(57) ABSTRACT

The invention relates to a differential current mirror circuit with low or eliminated differential current offset. The circuit comprises first and second input transistors $Q_{1i}$ and $Q_2$i whose physical layout is being matched and emitters connected together to a first reference voltage $V_{ref1}$ through an input resistance means $R_i$; first and second output transistors $Q_{1o}$ and $Q_{2o}$ whose physical layout is being matched and emitters connected together to a second reference voltage $V_{ref2}$ through an output resistance means $R_o$; collector and base of the first (second) input transistor $Q_{1i}$ ($Q_{2i}$) being connected to the base of the first (second) output transistor $Q_{1o}$ ($Q_{2o}$) and to a first (second) input current terminal to which a first (second) input current $i_{1i}$ ($i_{2i}$) is being supplied; and collector of the first (second) output transistor $Q_{1o}$ ($Q_{2o}$) being connected to a first (second) output current terminal generating first (second) output current $i_{1o}$ ($i_{2o}$). By using only one input and one output regeneration resistors and providing that the layout of the input and output transistors is matched in pairs, the output differential current offset of the circuitry is eliminated. A cascade of differential current mirror connected in series is also provided.

11 Claims, 5 Drawing Sheets

DIFFERENTIAL CURRENT MIRROR WITH LOW OR ELIMINATED DIFFERENTIAL CURRENT OFFSET

FIELD OF INVENTION

The invention relates to a current mirror, and in particular, to the differential current mirror having low or eliminated output differential current offset.

BACKGROUND OF THE INVENTION

A typical current mirror circuitry 10, which can be found in textbooks on microelectronics, is shown in FIG. 1*a* (see, e.g. "Microelectronics Circuits" by Adel S. Sedra and Kenneth C. Smith, Oxford University Press, 1991, pp. 428–435). This current mirror is known to be sensitive to parasitic resistances caused by interconnections between a transistor and other circuit elements as illustrated by dotted boxes in FIG. la at interconnection points "a", "b", "c" and "d". It means that minor variations of parasitic resistances result in exponential changes of the output current, which might be unacceptable in many practical situations. As an improvement to FIG. 1*a*, another prior art current mirror circuit 20, shown in FIG. 1*b*, includes regeneration resistors $R_{1i}$, $R_{1o}$, $R_{2i}$, and $R_{2o}$ at corresponding interconnection points. As a result, the improved current mirror becomes substantially less sensitive to parasitic resistances due to the fact that regeneration resistances are much greater than parasitic resistances and therefore provide much less relative variations of the magnitude of the combined resistances.

However, introduction of regeneration resistors, while solving the above-mentioned circuit sensitivity problem, introduces another inherent problem of having a differential current offset caused by a mismatched layout of regeneration resistors. It means that the output differential current offset exists even though all the transistors are matched and differential current at the input of the current mirror is zero. Accordingly, there is a need to design a current mirror circuitry which would provide reduced or no differential current offset while maintaining other qualities of the circuitry.

SUMMARY OF THE INVENTION

It is therefore an object of the invention to provide a differential current mirror with low or eliminated differential current offset while providing low sensitivity to parasitic resistances at interconnection points.

According to one aspect of the invention there is provided a differential current mirror, comprising:

first and second input transistors $Q_{1i}$ and $Q_{2i}$ whose physical layout is being matched and emitters connected together to a first reference voltage $V_{ref1}$ through an input resistance means $R_i$;

first and second output transistors $Q_{1o}$ and $Q_{2o}$ whose physical layout is being matched and emitters connected together to a second reference voltage $V_{ref2}$ through an output resistance means $R_o$;

collector and base of the first (second) input transistor $Q_{1i}$ ($Q_2$i) being connected to the base of the first (second) output transistor $Q_{1o}$ ($Q_{2o}$) and to a first (second) input current terminal to which a first (second) input current $i_{1i}$ ($i_{2i}$) is being supplied;

collector of the first (second) output transistor $Q_{1o}$ ($Q_{2o}$) being connected to a first (second) output current terminal generating first (second) output current $i_{1o}$ ($i_{2o}$).

Conveniently, it may be arranged that $V_{ref1}=V_{ref2}=V_{ref}$ and at least one of the input and output resistance means comprises a resistor. Alternatively, at least one of the input and output resistance means may comprise a semiconductor device having a resistance. Yet alternatively the input and output resistance means may comprise a variable resistance which is controlled by a digital or analog signal. Advantageously, it is provided that the magnitude of the variable resistance is a pre-determined function of the external signal, e.g. linear, quadratic, logarithmic or any other required function.

While preferred embodiments of the invention are illustrated for the current mirror based on BJT transistors, it is understood that other embodiments may include differential current mirrors using other transistors, e.g. MOSFET, FET, hetero-junction or any other known types of transistors.

Conveniently, a differential current gain of the current mirror may be controlled by changing magnitude of input and output resistances $R_i$ and $R_o$ and/or sizes of the transistors.

The differential current mirror of the invention is less sensitive to the parasitic resistances at interconnections and provides low or eliminated differential output current offset.

BRIEF DESCRIPTION OF THE DRAWINGS

Embodiments of the invention will now be described, by way of example, with reference to the accompanying drawings in which.

DESCRIPTION OF THE PREFERRED EMBODIMENTS

Figure 1A:
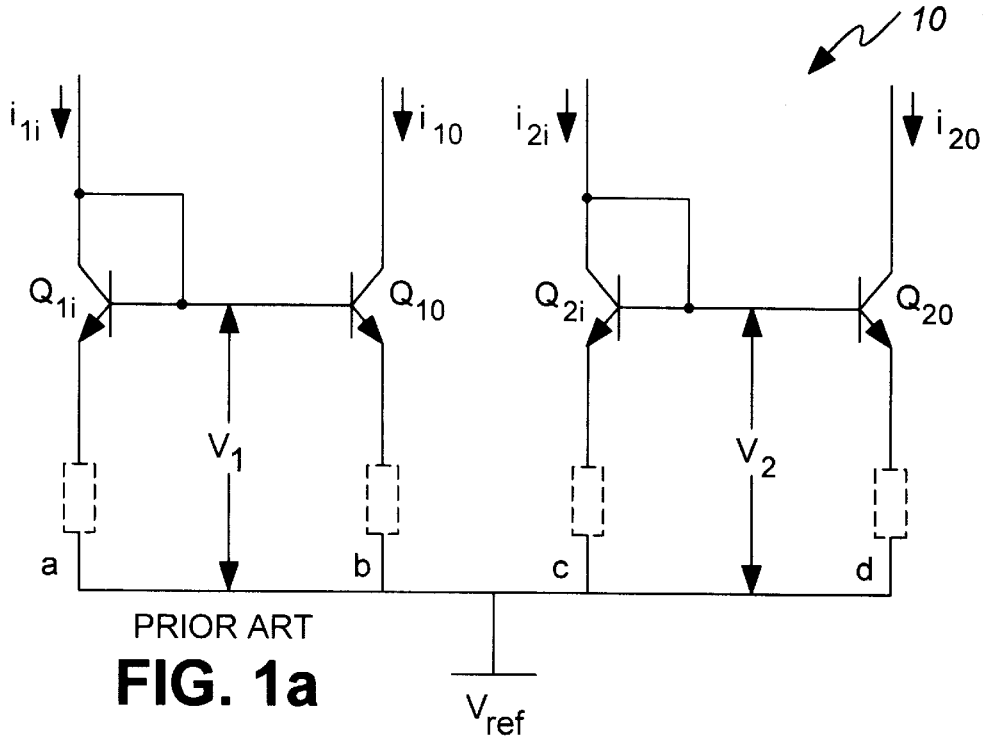
PRIOR ART FIG. 1a
FIGS. 1*a* and 1*b* illustrate current mirror circuitry according to the prior art.
Figure 1B:
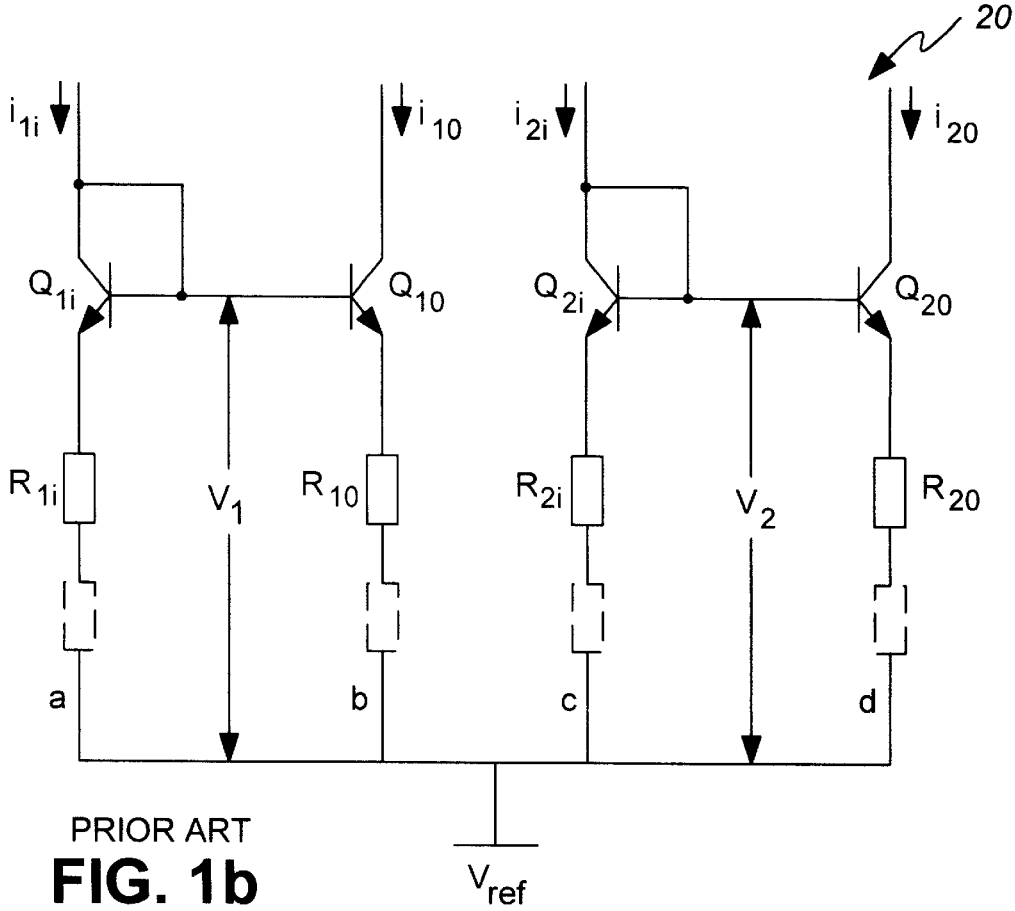
PRIOR ART FIG. 1b
Figure 2:
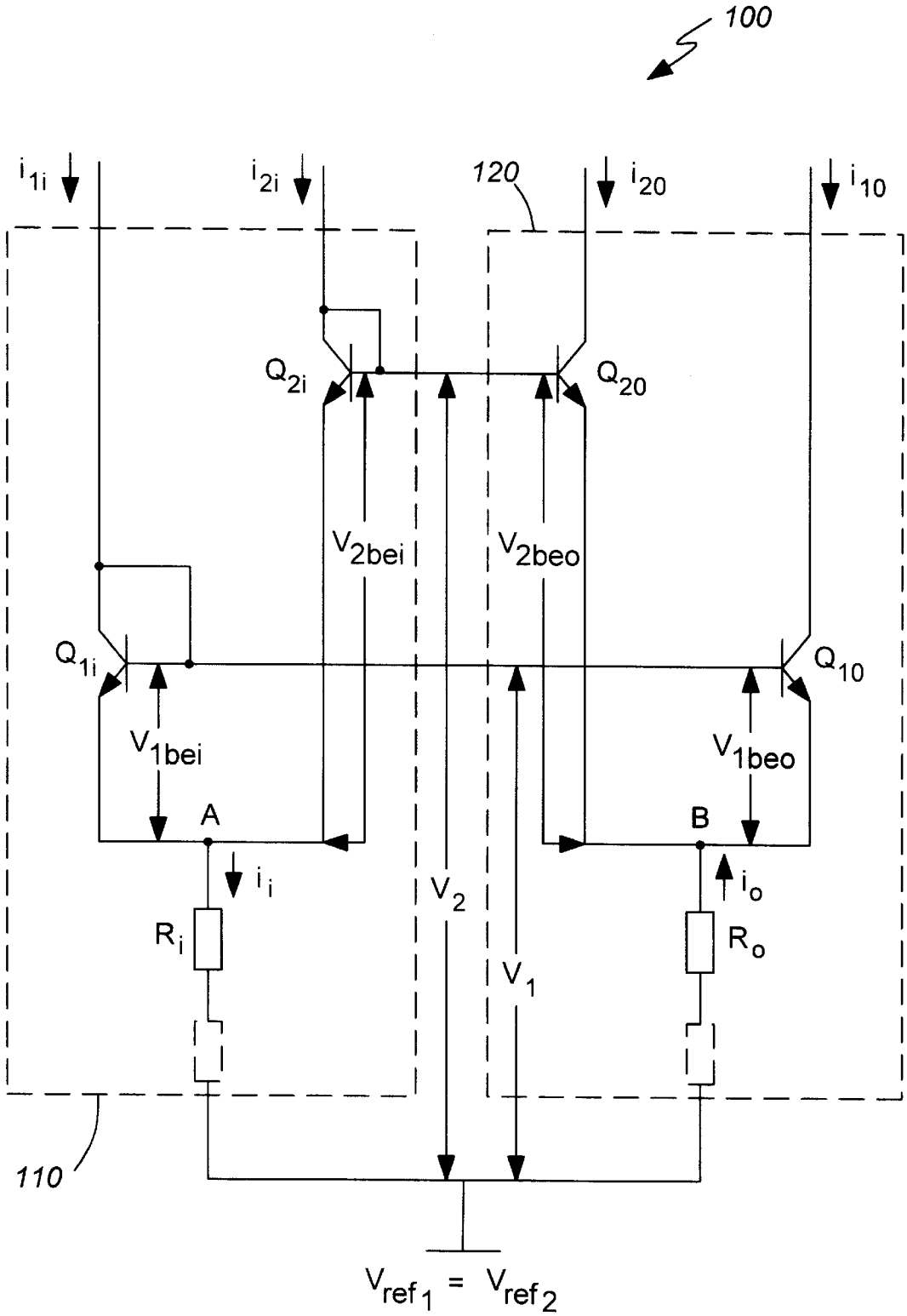
FIG. 2 illustrates a differential current mirror according to a first embodiment of the invention.

A differential current mirror 100 according to the first embodiment of the invention is shown in FIG. 2. It includes first and second input transistors $Q_{1i}$ and $Q_{2i}$, input and output resistance means represented by input and output regeneration resistors $R_i$ and $R_o$, and first and second output transistors $Q_{1o}$ and $Q_{2o}$ respectively. It is arranged that either all the transistors have matched physical layout, or input and output transistors have matched layout in pairs, i.e. $Q_{1i}$ is matched with $Q_{2i}$ and $Q_{1o}$ is matched with $Q_{2o}$. Emitters of the first and second input transistors $Q_{1i}$ and $Q_{2i}$ are connected together and to a first reference voltage $V_{ref1}$ through the input resistor $R_i$. Collector and base of the first input transistor $Q_{1i}$ are connected to the base of the first output transistor $Q_{1o}$ and to the first input current terminal to which a first input current ir is supplied. Similarly, collector and base of the second input transistor $Q_{2i}$ are connected to the base of the second output transistor $Q_{2o}$ and to a second input current terminal to which a second input current $i_{2i}$ is supplied. Emitters of the first and second output transistors $Q_{1o}$ and $Q_{2o}$ are connected together and to a second reference voltage $V_{ref2}$ through an output resistor $R_o$. Accordingly, the collector of the first output transistor $Q_{1o}$ is connected to a first output current terminal generating first output current $i_{1o}$, and the collector of the second output transistor $Q_{2o}$ is connected to a second output current terminal generating second output current $i_{2o}$ as illustrated in FIG. 2. For simplicity of derivations only it is assumed that $V_{ref1}=V_{ref2}=V_{ref}$.

Principles of operation

First and second input transistors $Q_{1i}$, $Q_{2i}$ and the input resistor $R_i$ form a master leg of the differential current mirror which is designated by reference numeral 110 in FIG. 2. Accordingly, first and second output transistors $Q_{1o}$ and $Q_{2o}$ along with the output resistor $R_o$ form a slave leg 120 of the differential current mirror as shown in FIG. 2. The master leg 110 of the current mirror 100 converts differential input current ($i_{1i}-i_{2i}$) into a differential voltage ($V_1-V_2$) applied between bases of the first and second output transistors $Q_{1o}$, $Q_{2o}$ respectively. The slave leg 120 converts differential voltage ($V_1-V_2$) into a differential output current ($i_{1o}-i_{2o}$) as illustrated in FIG. 2.

When $i_{1i}=i_{2i}$, i.e. there is no current offset between the input currents $i_{1i}$ and $i_{2i}$, the differential voltage ($V_1-V_2$), applied between the bases of the first and second output transistors $Q_{10}$, $Q_{2o}$ respectively, equals zero because emitters of the input transistors $Q_{1i}$, and $Q_{2i}$, are connected together and to the same point "A" as shown in FIG. 2. Accordingly, equal voltages $V_1$ and $V_2$ applied to the bases of the output transistors $Q_{1o}$ and $Q_{2o}$generate equal output currents $i_{1o}=i_{2o}$ because emitters of the output transistors are connected together and to the same point "B" as illustrated in FIG. 2. As a result, there is no output differential current offset caused by a mismatch between the resistors $R_i$ and $R_o$ assuming that input and output transistors are matched in pairs as described above. Elimination of differential current offset is achieved due to the symmetry of the current mirror circuitry 100 and use of only one input resistor $R_i$ and one output resistor $R_o$.

This conclusion is confirmed by calculations for the output current offset below which by way of example are performed for the current mirror using bipolar transistors.

It is known that a collector current of a bipolar transistor may be expressed as follows (see, e.g. the above referenced textbook on Microelectronics Circuits by Sedra and Smith)

$$i=i_sA\exp(V_{be}/V_T) \tag{1}$$

wherein $i_s$ is a constant called a saturation current, $V_T$ is a thermal voltage, A is an emitter area, and $V_{be}$ is a voltage between the base and emitter.

Accordingly, applying equation (1) to transistors $Q_{1i}$, $Q_{2i}$, $Q_{1o}$, $Q_{2o}$ of the circuitry 100 we obtain expressions for corresponding collector currents of the transistors:

$$i_{1i}=i_sA_i\exp(V_{1bei}/V_T) \tag{2}$$

$$i_{2i}=i_sA_i\exp(V_{2bei}/V_T) \tag{3}$$

$$i_{1o}=i_sA_o\exp(V_{1beo}/V_T) \tag{4}$$

$$i_{2o}=i_sA_o\exp(V_{2beo}/V_T) \tag{5}$$

wherein $V_{1bei}$, $V_{2bei}$, $V_{1beo}$ and $V_{2beo}$ are corresponding base-emitter voltages of the transistors.

Taking into account that $$i_i=i_{1i}+i_{2i} \tag{6}$$

$$i_o=i_{1o}+i_{2o} \tag{7}$$

$$V_1=i_iR_i+V_{1bei} \tag{8}$$

$$V_1=i_oR_o+V_{1beo} \tag{9}$$

$$V_2=i_iR_i+V_{2bei} \tag{10}$$

$$V_2=i_oR_o+V_{2beo} \tag{11}$$

and expressing $V_{1bei}$, $V_{2bei}$, $V_{1beo}$ and $V_{2beo}$ from equations (8)–(11), we may find input and output differential current offsets:

$$i_{1i}-i_{2i}=i_sA_i\cdot[\exp(V_{1bei}/V_T)-\exp(V_{2bei}/V_T)]=$$
$$=i_sA_i\exp(-R_ii_i/V_T)\cdot[\exp(V_1/V_T)-\exp(V_2V_T)] \tag{12}$$

$$i_{1o}-i_{2o}=i_sA_o\cdot[\exp(V_{1beo}/V_T)-\exp(V_{2beo}/V_T)]=$$
$$=i_sA_o\exp(-R_oi_o/V_T)\cdot[\exp(V_1/V_T)-\exp(V_2V_T)] \tag{13}$$

As follows from equation (12), in the absence of input differential current offset ($i_{1i}-i_{2i}=0$), voltages applied to the bases of the first and second transistors are also equal ($V_1=V_2$). Correspondingly, the right part of equation (13) equals zero, which means that $i_{1o}=i_{2o}$, i.e. there is no differential output current offset.

Taking into account equations (12) and (13) and neglecting current gain (β) of individual transistors, differential gain of the current mirror 100, defined as a ratio of the output and input differential currents, may be expressed as follows:

$$G_i=\frac{i_{1o}-i_{2o}}{i_{1i}-i_{2i}}=\frac{A_o}{A_i}\exp((R_ii_i-R_oi_o)/V_T) \tag{14}$$

As follows from equation (14), differential gain of the current mirror is a function of the sizes of the transistors and magnitude of input and output resistors and can be controlled accordingly.

The differential current mirror 100 described above has been implemented by use of Si—Ge technology and has the following parameters: length of the transistors is from about 2 micrometers to about 64 micrometers, $R_o$ falls within a range from about 6 Ohm to 200 Ohm, and $R_o/R_i$ is from about 4 to 8 times.

In modifications of this embodiment, the differential current mirror 100 may comprise different types of transistors, e.g. MOSFET, FET hetero-junction or any other known transistors. The input and output resistance means may comprise a resistor or combination of resistors, or alternatively a semiconductor or any other device having resistance. First and second reference voltages may have equal or different magnitude depending on the circuit requirements.

Figure 3:
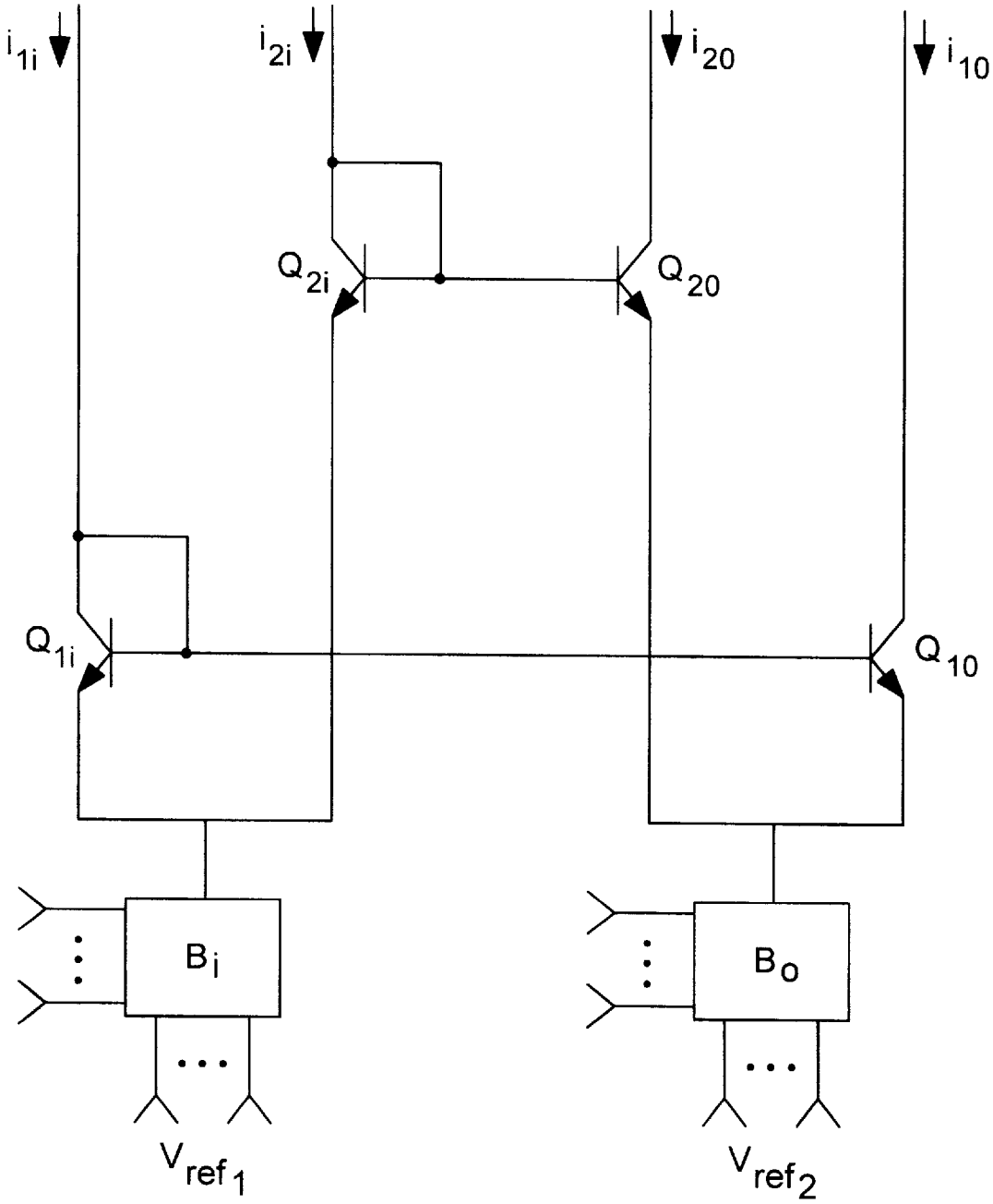
FIG. 3 illustrates a differential current mirror according to a second embodiment of the invention.
Figure 4A:
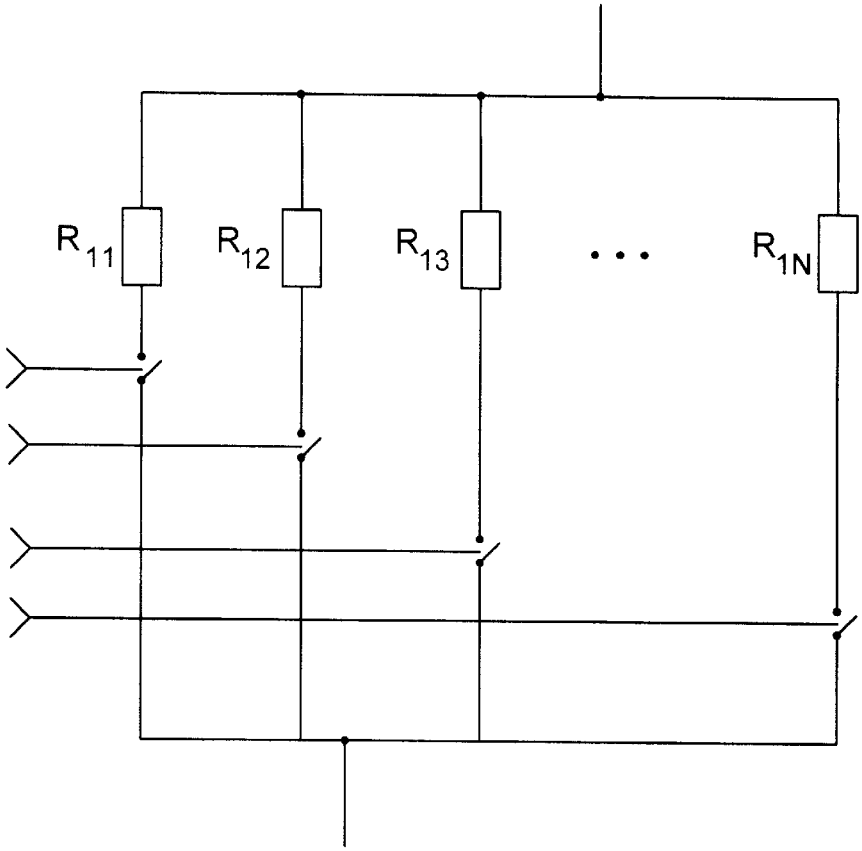
FIGS. 4*a* to 4*c* illustrate various arrangements for digitally controlled variable resistances used in the current mirror of FIG. 3.
Figure 4B:
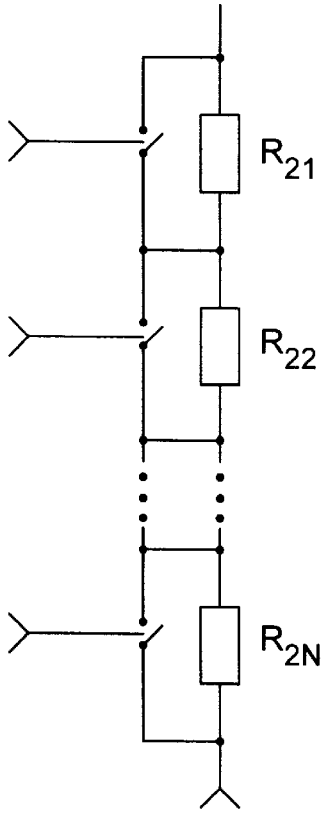
Figure 4C:
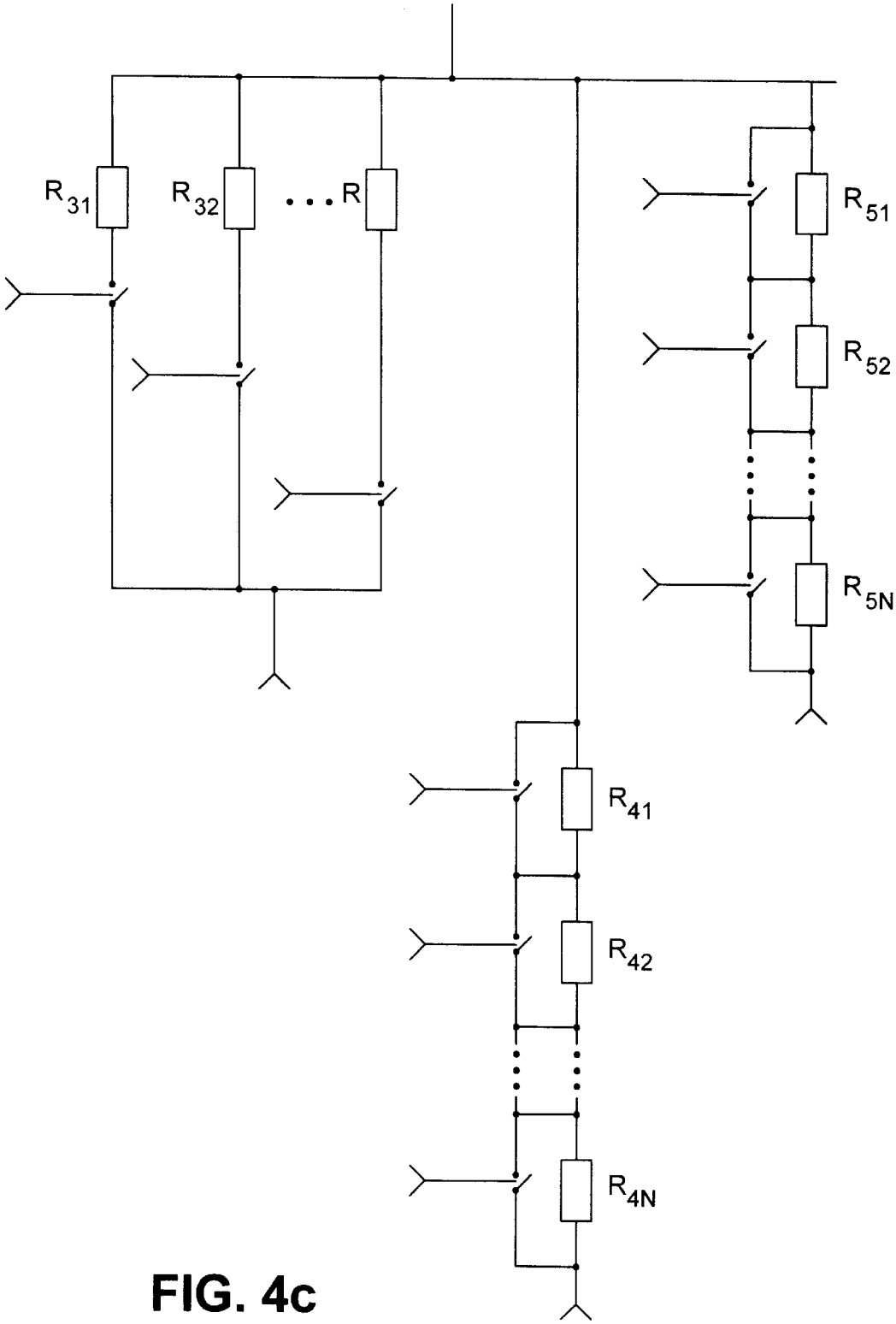

A differential current 200 mirror according to the second embodiment of the invention is shown in FIG. 3. It is similar to that of the first embodiment described above shown in FIG. 2 except for the regeneration resistors $R_i$ and $R_o$ being replaced with respective blocks $B_i$ and $B_o$ of variable resistances which are controlled by an external signal. By way of example, FIGS. 4*a* to 4*c* illustrate some possible arrangements for variable resistances $B_i$ and $B_o$ controlled by digital signals. Alternatively, resistances $B_i$ and $B_o$ may be controlled by analog signals depending on the circuit requirements. Conveniently, blocks $B_i$ and $B_o$ may be designed so as to provide that the magnitude of the variable resistances is a pre-determined function of the external signal, e.g. linear, quadratic or logarithmic function.

In modifications to the above embodiments it is possible to arrange for a cascade of N differential current mirror stages connected in series, wherein each stage comprises the differential current mirror of the first embodiment described above. Differential output currents generated by each of the preceding stages are supplied as differential input currents to the corresponding succeeding stages of the cascade. Such a cascade provides high current gain which can be controlled for each stage independently while ensuring no differential current offset for individual stages and the cascade as a whole.

Thus, it will be appreciated that, while specific embodiments of the invention are described in detail above, numerous variations, combinations and modifications of these embodiments fall within the scope of the invention as defined in the following claims.

What is claimed is:

1. A differential current mirror, comprising:

first and second input transistors $Q_{1i}$ and $Q_{2i}$ whose physical layout is being matched and emitters connected together to a first reference voltage $V_{ref1}$ through an input resistance means $R_i$;

first and second output transistors $Q_{1o}$ and $Q_{2o}$ whose physical layout is being matched and emitters connected together to a second reference voltage $V_{ref2}$ through an output resistance means $R_o$;

collector and base of the first (second) input transistor $Q_{1i}$ ($Q_{2i}$) being connected to the base of the first (second) output transistor $Q_{1o}$ ($Q_{2o}$) and to a first (second) input current terminal to which a first (second) input current $i_{1i}$ ($i_{2i}$) is being supplied; and collector of the first (second) output transistor $Q_{1o}$ ($Q_{2o}$) being connected to a first (second) output current terminal generating first (second) output current $i_{1o}$ ($i_{2o}$).

2. A differential current mirror as defined in claim 1, wherein $V_{ref1}=V_{ref2}$.

3. A differential current mirror as defined claim 1, wherein at least one of the input and output resistance means comprises a resistor.

4. A differential current mirror as defined in claim 1, wherein at least one of the input and output resistance means comprises a semiconductor device having a resistance.

5. A differential current mirror as defined in claim 1, wherein at least one of the input and output resistance means comprises a variable resistance.

6. A differential current mirror as defined in claim 5, wherein the variable resistance is controlled by an external signal, the signal being one of the digital and analog signals.

7. A differential current mirror as defined in claim 6, wherein the magnitude of the variable resistance is a pre-determined function of the external signal.

8. A differential current mirror as defined in claim 7, wherein the pre-determined function is selected from the group consisting of linear, quadratic and logarithmic functions.

9. A differential current mirror as defined in claim 1, wherein the transistors are selected from the group consisting of BJT, MOSFET, FET hetero-junction transistors.

10. A differential current mirror as defined in claim 1, wherein a differential current gain of the mirror is controlled by magnitudes of input and output resistance means $R_i$ and $R_o$.

11. A differential current mirror as defined in claim 1, wherein a differential current gain of the mirror is controlled by sizes of the transistors.

* * * * *